US005211124A

United States Patent [19]

Reiser

[11] Patent Number: 5,211,124

[45] Date of Patent: May 18, 1993

[54] WINCH CONSTRUCTION FOR BOAT LIFT

[75] Inventor: John N. Reiser, Allenton, Wis.

[73] Assignee: Triton Corporation, Allenton, Wis.

[21] Appl. No.: 847,919

[22] Filed: Mar. 6, 1992

[51] Int. Cl.[5] ..... B63C 7/00; B63B 21/56; B63B 35/00; B63B 35/73

[52] U.S. Cl. ..... 114/44; 114/268; 114/242; 114/270

[58] Field of Search ..... 114/268, 51, 242, 243, 114/253, 270, 94, 45–48; 405/3–7

[56] References Cited

U.S. PATENT DOCUMENTS

| | | | |
|---|---|---|---|
| 2,229,110 | 1/1941 | McKinnon | 114/268 |
| 4,787,327 | 11/1988 | Porter | 114/44 |
| 5,051,027 | 9/1991 | Horton | 114/44 |
| 5,090,842 | 2/1992 | Montgomery | 114/44 |
| 5,143,182 | 9/1992 | Basta | 114/44 |

OTHER PUBLICATIONS

Brochure—Triton Corporation, Allenton, Wisc.

*Primary Examiner*—Joseph F. Peters, Jr.
*Assistant Examiner*—Kenneth Lee
*Attorney, Agent, or Firm*—Andrus, Sceales, Starke & Sawall

[57] ABSTRACT

A winch construction for a boat lift. The winch includes a pair of spaced side plates, and a shaft is journaled in aligned openings in the side plates. The ends of the shaft project beyond the side plates and a drum is located between the side plates and is journaled on the shaft. A chain drive connects one projecting end of the shaft to a second shaft which is journaled in the side plates, and a second speed reduction chain drive connects the second shaft with the drum which carries a cable which is attached to the boat lift. A hand wheel is connected to a hub that is threaded on the opposite projecting end of the shaft, and an annular ratchet is located between the hub and a backing plate attached to the respective side plate. The ratchet is composed of a brake material and has a brake surface facing the backing plate. To elevate the boat lift, the hand wheel is rotated causing the hub to move axially on the shaft and effecting engagement of the brake surface with the backing plate. With the brake engaged, further rotation of the hand wheel will rotate the shaft and rotation of the shaft will be transmitted through the chain drive to rotate the drum and wind the cable on the drum. The outer periphery of the ratchet has a plurality of teeth which are engaged by a pawl, which engagement serves to hold the boat lift at an elevated position and prevent unwinding of the cable from the drum.

10 Claims, 3 Drawing Sheets

FIG. 1
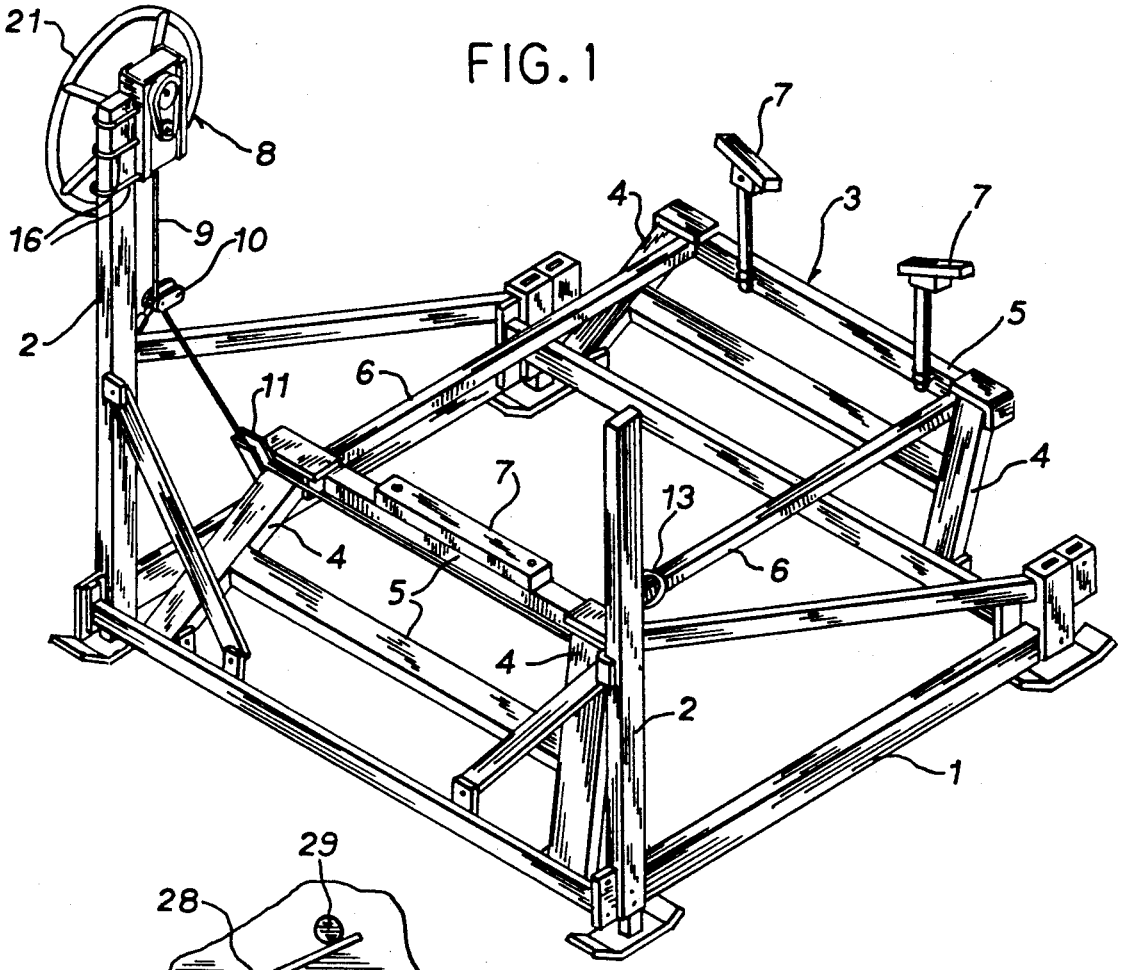
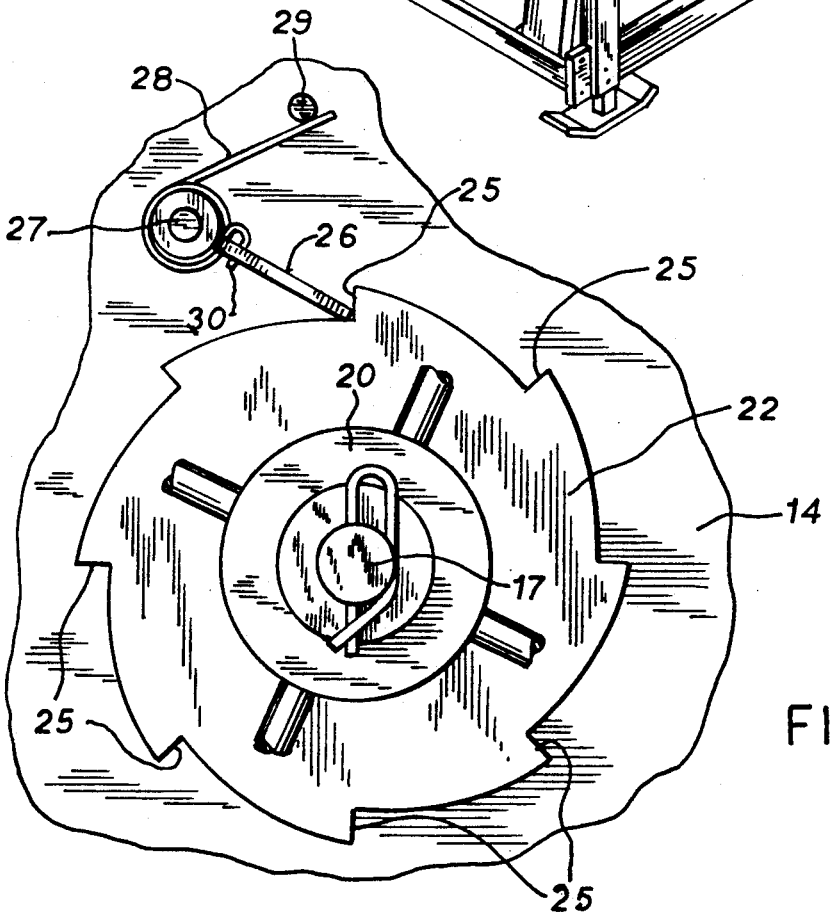
FIG. 3

WINCH CONSTRUCTION FOR BOAT LIFT

BACKGROUND OF THE INVENTION

Manually operated boat lifts are frequently employed to lift a boat out of the water and lock the boat in an elevated position. The typical boat lift includes a frame which is mounted on the bed of the body of water, and the frame carries a movable sub-frame that can be moved by a winch mechanism from a lower, submerged position to an elevated position to thereby lift the boat from the water.

The conventional winch mechanism includes a large diameter hand wheel and rotation of the hand wheel operates through a chain drive speed reducing mechanism to rotate the winch drum and thereby wind the cable on the drum to lift or elevate the boat. More particularly, in the conventional winch mechanism, the hand wheel is secured to an annular hub that is threaded on the end of a shaft. Rotation of the hand wheel in the elevating mode will move the hub axially on the shaft to engage a brake pad that is attached to one surface of a rachet plate. A second brake pad attached to the opposite surface of the rachet plate is engaged with a backing plate secured to a side plate of the winch. With this construction, a predetermined amount of axial movement of the hub on the shaft will engage the brake pads so that further rotation of the hand wheel will rotate the shaft. Rotation of the shaft is transmitted through one or more speed reducing mechanisms to the drum shaft to thereby rotate the drum and wind the cable on the drum and elevate the boat.

It has been found that when employing brake pads attached to opposite surfaces of the rachet plate, the hub and backing plate tend to dig into the pads so that the brake will not readily release upon opposite rotation of the hand wheel. Often, it is necessary to jerk the winch to provide a release.

As the chain drive speed reduction units in the winch constructions of the past have been located between the side plates of the winch, there has been no ability to readily vary the speed reducing ratio. Further, due to the fact that the chain drives of the prior winch constructions were located between the side plates, the winch could not be reversed from left to right with respect to the boat lift frame so that separate right and left winches have been required to accommodate the desired location of the winch.

SUMMARY OF THE INVENTION

The invention is directed to an improved winch construction for a boat lift. The winch includes a pair of spaced side plates and a drive shaft is journaled for rotation within aligned openings in the side plates with the ends of the shaft projecting beyond the respective side plates.

A cable attached to the boat lift is wound on a drum which, in turn, is located between the side plates and mounted for rotation on the drive shaft.

One of the projecting ends of the shaft is connected through a speed reducing chain drive to a second shaft which is parallel to the drive shaft and is also journaled for rotation with respect to the side plates. A second speed reducing chain drive connects the second shaft with the drum.

To wind the cable on the drum and elevate the boat lift, a hand wheel is connected to an annular hub that is threaded on the opposite projecting end of the drive shaft. An annular backing plate is secured to the drive shaft, while a ratchet disc formed of a composite brake material is freely mounted on the shaft. The ratchet disc functions as both a ratchet and a brake disc, and faces the backing plate. The periphery of the ratchet disc carries a plurality of rachet teeth which are engaged with a spring loaded pawl connected to one of the side plates.

In the elevating mode, the hand wheel is rotated, causing the hub to move axially on the shaft to engage the ratchet disc with the backing plate. Continued rotation of the hand wheel, with the brake engaged, will then rotate the drive shaft, and rotation of the drive shaft will be transmitted through the chain drives to the drum to wind the cable on the drum and elevate the lift. Engagement of the pawl with the rachet will hold the lift in the elevated position.

When it is desired to lower the boat lift, the hand wheel is rotated in a direction to disengage the brake disc, thus permitting the weight of the boat on the boat lift to unwind the cable from the drum to permit the boat lift to be lowered.

As one of the chain drives is located outside of the side plates of the winch, the speed reducing ratio can be readily varied by changing the size of the sprockets in the chain drive. This construction further enables the winch to be reversed so that it can be used on both the left or right side of the boat lift without alteration.

As a feature of the invention, the inner end of the drum cable is formed with a loop that is engaged with a projection or hook on the drum. When the lift is lowered and the cable is unwound, the loop will automatically release from the projection if the cable is fully paid out, thereby preventing reverse rotation of the drive shaft and free-wheeling of the hand wheel.

Other objects, features and advantages will appear in the course of the following description.

DESCRIPTION OF THE DRAWINGS

The drawings illustrate the best mode presently contemplated of carrying out the invention.

In the drawings:

FIG. 1 is a perspective view of a typical boat lift incorporating the winch mechanism of the invention;

FIG. 3 is a section taken along line 3—3 of FIG. 2;

DESCRIPTION OF THE ILLUSTRATED EMBODIMENT

Figure 4:
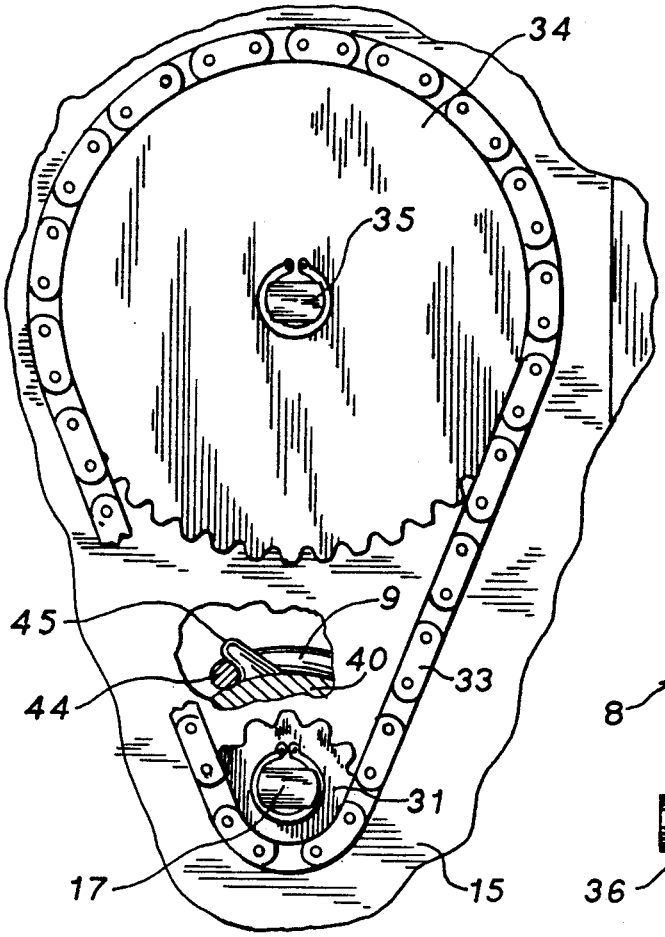
FIG. 4 is a fragmentary side elevation with parts broken away.

FIG. 1 illustrates the winch construction of the invention as incorporated with a boat lift. The boat lift is a conventional type and includes a generally rectangular frame 1 which is adapted to rest on the bed of a body of water. A pair of upright side posts 2 extend upwardly from the sides of frame 1.

A lifting sub-frame 3 is adapted to support a boat and is movable between a lower position, where it is normally submerged in the water, to an elevated position, where the boat will be elevated out of the water. As illustrated, the lift frame 3 is a swinging type including two pair of legs 4, each of which is mounted for pivotal movement relative to frame 1. The arms of each pair are connected by cross members 5 and longitudinal members 6 connect the legs 4 at the corresponding sides of the lift frame. Suitable boat support pads 7 are mounted on the cross members 5 and are positioned to support the hull of a boat.

The lift frame 3 is raised and lowered by a winch mechanism, indicated generally at 8. The winch mechanism includes a cable 9, as seen in FIG. 1, which extends over a pulley 10 mounted on one of the upright posts 2. The cable then passes over pulley 11, which is mounted on one of the legs 4 of the lift frame, then extends transversely of the lift frame and around a second pulley (not shown) on the opposite leg 4 and is dead-ended on the lift frame, as indicated at 13. Operation of the winch 8 will draw the cable 9 upwardly to move the lift frame 3 from the lowered to the elevated position.

As previously noted, the boat lift itself is of conventional construction and, in itself, forms no part of the present invention.

Winch mechanism 8 includes a pair of spaced parallel side plates 14 and 15, and the flanges of the side plates are connected to the upper end of one of the posts 2 by clamping rods 16.

Figure 2:
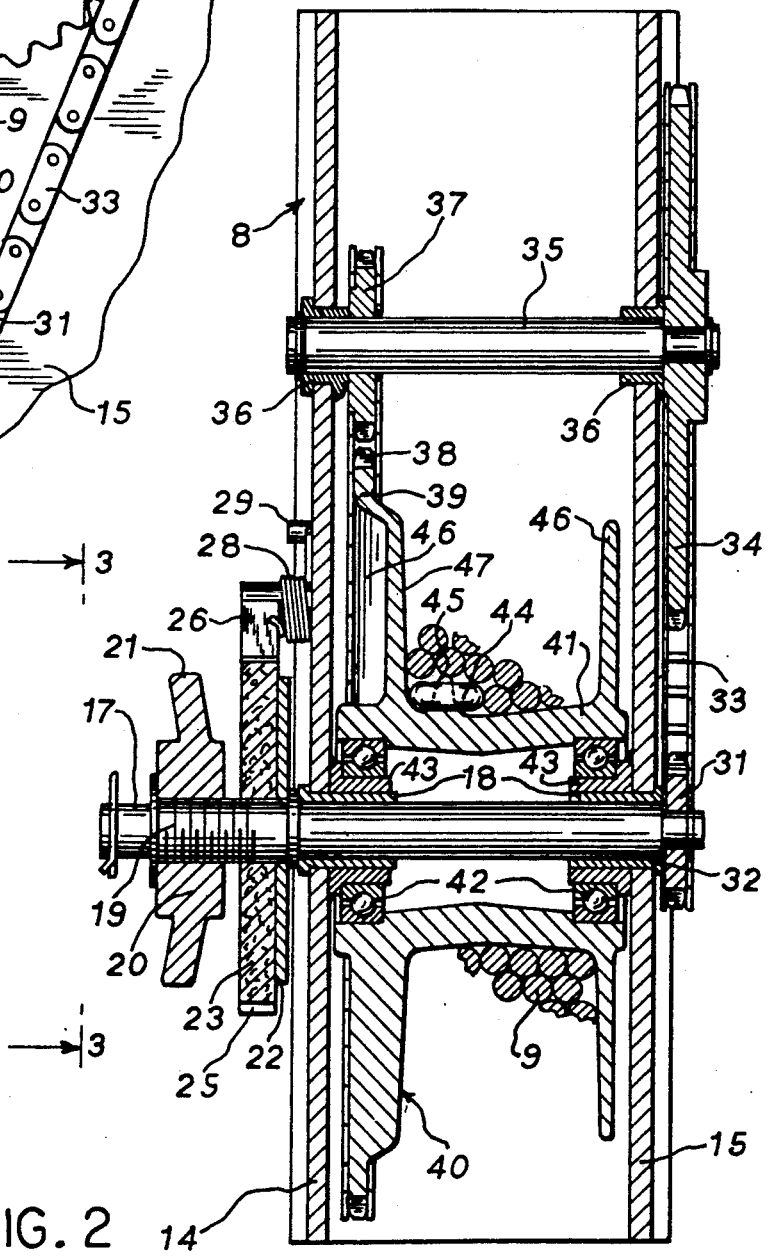
FIG. 2 is a vertical section of the winch.

As illustrated in FIG. 2, a drive shaft 17 extends through aligned openings in side plates 14 and 15 with the ends of the shaft projecting beyond the corresponding side plates. Shaft 17 is journaled for rotation with respect to the side plates 14 and 15 by bushings 18 which are attached to the respective side plates and journal the shaft.

One end of drive shaft 17 is threaded, as indicated at 19, and a hub 20 is engaged with the threaded end 19. A large diameter hand wheel 21 is secured to the hub 20 and manual rotation of the hand wheel will cause the hub 20 to move axially on shaft 17.

An annular backing plate 22 is secured to the projecting end of shaft 17 and is located outwardly of side plate 14. Mounted adjacent backing plate 22 is a combination ratchet plate and brake disc 23 which is formed of a conventional composite brake material. The ratchet plate/brake disc 23 is mounted for free rotation on the shaft 17.

As best seen in FIG. 3, the periphery of the ratchet plate 23 is formed with a plurality of teeth 25 which are engaged by a locking pawl 26 that is pivotally connected to side plate 14 by pivot pin 27. Torsion spring 28 urges the pawl into locking engagement with the rachet teeth 25.

One end of spring 28 bears against a pin 29 that projects outwardly from side plate 14, while the opposite end of the spring passes around the hub of pawl 26, and is bent over the pawl, as indicated by 30. With this construction, the force of spring 28 will urge pawl 26 into engagement with the ratchet teeth 25. The ratchet and pawl arrangement permit free rotation of the ratchet plate in a direction to elevate the boat lift and prevents rotation of the ratchet plate in the opposite direction, unless the pawl is released.

As previously noted, rotation of hand wheel 21 will move hub 20 axially on shaft 17 to engage the disc 23 with backing plate 21. With the brake disc 23 engaged, continued rotation of the hand wheel Will then rotate drive shaft 17.

As best illustrated in FIG. 2, the opposite end of shaft 17 projects beyond side plate 15 and a sprocket 31 is mounted on the projecting end of the shaft. The ends of bushings 18 are formed with radial flanges 32 that bear against the outer surfaces of side plates 14 and 15, respectively, and serve as thrust bearings.

Sprocket 31 is connected via a chain 33 to a second sprocket 34 which is mounted on shaft 35. Shaft 35 is parallel to shaft 17 and is journaled within aligned openings in side plates 14 and 15 by bushings 36.

In addition to sprocket 32, a second sprocket 37 is secured to shaft 35 and is located adjacent the inner surface of side plate 14. Sprocket 37 is connected by chain 38 to a sprocket 39 on drum 40 which is mounted for rotation between side plates 14 and 15.

Drum 40 includes an inner hub 41 which is journaled for rotation relative to side plates 14 and 15 by bearings 42 which are interposed between the hub 41 and flanged rings 43 that are attached to the side plates.

The inner end of cable 9 is provided with a loop or eye 44, which is engaged with a hook or projection 45 on hub 41 of drum 40, as shown in FIG. 4. The cable is wound on the hub 41 and the windings are retained by side plates 46 which extend radially from the ends of the hub. A projection 47, shown in FIG. 2, extends inwardly from one of the side plates 46 adjacent the sprocket 39 and acts to prevent the wound cable from contacting the sprocket.

After the brake 23 is engaged with backing plate 22 by initial rotation of the hand wheel 21, as previously described, continued rotation of the hand wheel will rotate shaft 17 and rotation of the shaft will be transmitted through the chain drive 33 to shaft 35 and then to the drum 40 via the chain drive 38 to elevate the lift frame 3 and each chain drive will provide a substantial speed reduction. The ratchet and pawl mechanism will hold the lift frame 3 at any desired location.

When it is desired to lower the lift frame 3 and the boat supported thereon, the pawl 26 is manually released and the hand wheel 21 is rotated in a direction to unthread the hub 20 from the end of shaft 17 and release disc 23 from contact with plate 22.

With the brake released, the weight of the boat on lift frame 3 will cause the lift frame to move to its lowered submerged position to thereby lower the boat into the water. Manual engagement of the hand wheel 21 can slow the descent of the lift frame.

In the event the lift frame 3 and boat are lowered suddenly, the cable 9 may fully unwind and the engagement of the loop end 44 with the hook 45 will automatically release the cable from the drum and prevent reverse rotation of the shaft, which could cause freewheeling of the hand wheel 21 and possible injury to an operator. As shown in FIG. 4, the hook 45 is canted, so that it extends at an angle to a radial direction and thus the looped end 44 will be automatically released from the hook when the cable 9 is fully unwound from the drum.

As the chain drive 33 is located on the outside of the side plates 14,15, the speed reducing ratio can be readily varied by substituting sprockets of different size. In addition, the winch construction of the invention is reversible, meaning that it can be used on either side of the boat lift by merely inverting the winch and without alteration of any of the components. This is a substantial advantage over conventional types of winches, which can only be mounted on one side of the boat lift.

Figure 5:
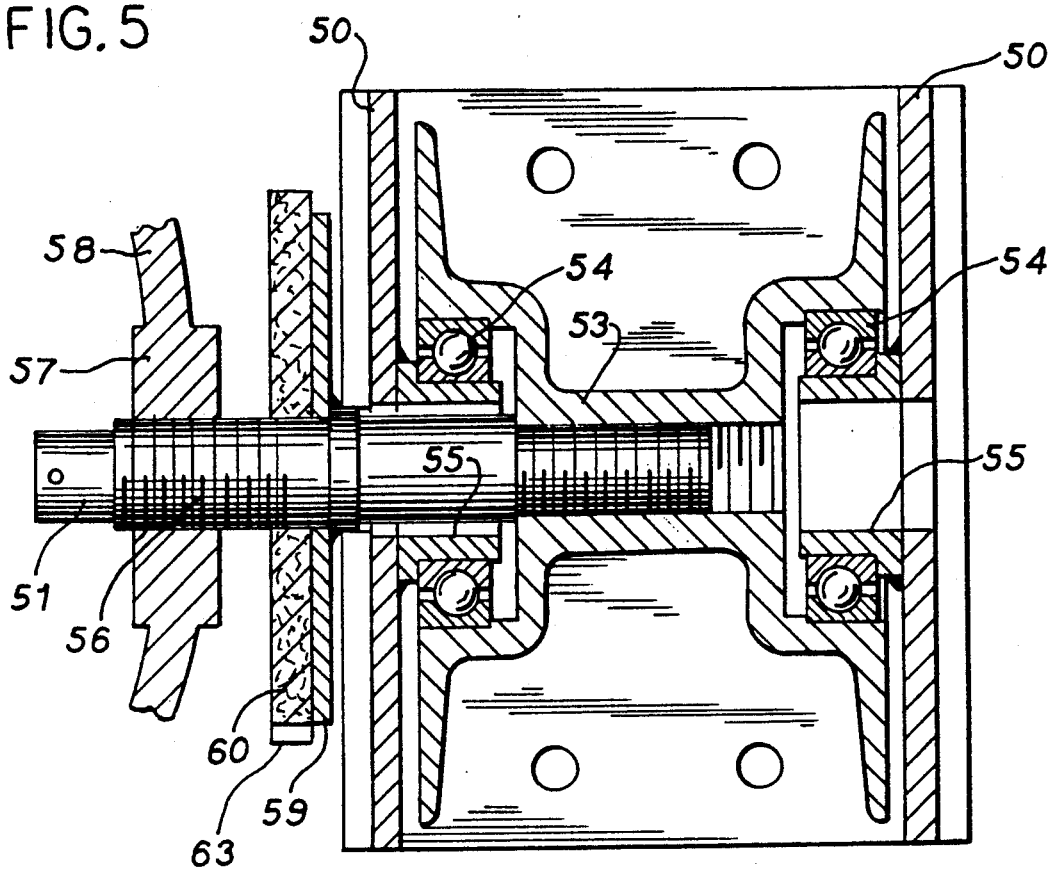
FIG. 5 is a vertical section of a modified form of the invention.
Figure 6:
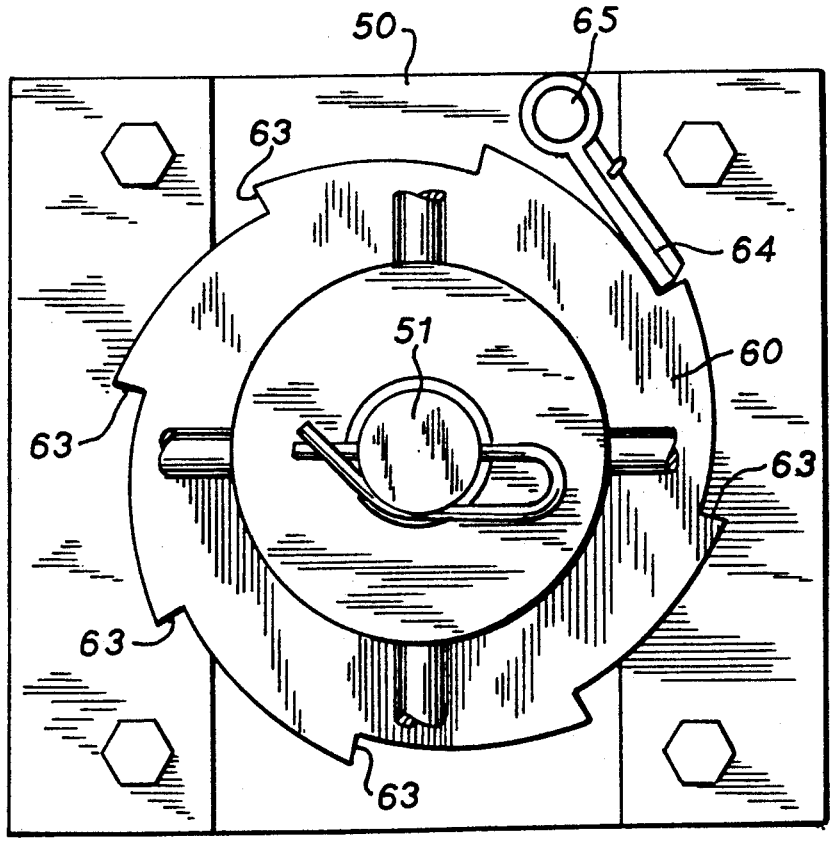
FIG. 6 is an end view of the structure shown in FIG. 5.

FIG. 5 illustrates a modified form of the invention utilizing a one-to-one drive ratio between the hand wheel and the winch drum. The winch, as illustrated in FIG. 5, includes a pair of parallel side plates 50 and a shaft 51 extends through an opening in one of the side plates 50. A drum 53 is threaded to the shaft 51 and is journaled by bearings 54 on rings 55 secured to the inner surfaces of side plates 50. A cattle, not shown, similar to cable 9 of the first embodiment is wound on drum 53.

As illustrated in FIG. 5, one end of shaft 51 has a threaded end, as indicated by 56, and the hub 57 of a large diameter hand wheel 58 is threaded on end 56.

An annular backing plate 59 is secured to the projecting end of shaft 51 and is located adjacent one of the side plates 50. A combination ratchet/brake disc 60, similar in construction to disc 23 of the first emobiment, is mounted for free rotation on shaft 51.

As previously described with respect to the first embodiment, ratchet/brake disc 60 is provided with a plurality of peripheral teeth 63 which are engagable by a spring loaded pawl 64, which is pivotally mounted on pin 65 that projects outwardly of one of the side plates 50. Pawl 64 functions similar to pawl 26 of the first embodiment.

The winch of FIG. 5 operates in the manner previously described, except that there is a one-to-one drive ratio between the hand wheel 58 and the drum 51. To elevate the lift frame 3, the hand wheel 58 is rotated in a direction to move the hub 57 against the washer 62, thereby engaging the brake disc 60 with the backing plate 59. With the brake disc 60 engaged, continued rotation of the hand wheel will provide rotation of shaft 51 to thereby rotate the drum 53 in a direction to wind the cable on the drum and elevate the lift frame 3.

To lower the lift frame 3, the procedure is reversed, with the hand wheel 58 being rotated in a direction to unthread the hub 57 from the shaft end 56, thus releasing the brake disc 60 and enabling the lift frame to lower by gravity to lower the boat into the water.

Various modes of carrying out the invention are contemplated as being within the scope of the following claims particularly pointing out and distinctly claiming the subject matter which is regarded as the invention.

I claim:

1. A winch construction for a boat lift, comprising a pair of spaced side members, a first shaft mounted for rotation in aligned openings in the side members, the ends of the shaft protecting beyond the respective side members, a drum mounted for rotation on said first shaft, a cable wound or the drum and disposed to be connected to the boat lift, manually operable drive means connected to one end of the shaft for rotating the shaft, a second shaft disposed between said side plates and mounted for rotation relative to said side plates, first speed reducing drive means operably connecting the opposite end of said first shaft to said second shaft and located outside of said side members, and second speed reducing means connecting said second shaft and said drum and located between said side members.

2. The winch construction of claim 1, wherein said first and second speed reducing means comprise chain drives.

3. The winch construction of claim 1, wherein said drive means comprises a hand wheel, a hub secured to said hand wheel and threadedly engaged to said one end of the first shaft whereby rotation of said hand wheel will move said hub axially of said shaft, a backing plate connected to said shaft and located outside of said members, and brake means disposed between said hub and said backing plate, whereby a predetermined amount of axial movement of said hub on said first shaft will actuate said brake means and cause a braking engagement between said hub and said backing plate so that further rotation of said hand wheel will rotate said first shaft to thereby rotate said drum through said first and second speed reducing drive means.

4. The winch construction of claim 3, and including releasible one-way locking means operably connected to the shaft for permitting free rotation of said shaft in one direction and preventing rotation of the shaft in the opposite direction unless released.

5. The winch construction of claim 4, wherein said releasable one-way locking means comprises a ratchet secured to said brake means and mounted for free rotation on said shaft, said ratchet having a plurality of ratchet teeth and a pawl mounted on one of said side members and engaged with said ratchet teeth.

6. The winch construction of claim 5, wherein said brake means and said ratchet comprise an integral structure composed of a composite brake material.

7. A winch construction for a boat lift, comprising a pair of spaced side plates, a drive shaft mounted for rotation within aligned openings in the side plates, an end of said shaft projecting beyond the respective side plates, a drum disposed between said side plates and mounted for rotation or said shaft, a cable wound on the drum and disposed to be connected to a boat lift, a hand wheel, a hub secured to said hand wheel and threadedly engaged with said end of the shaft whereby rotation of said hand wheel will move said hub axially of said shaft, a backing member secured to said shaft and spaced from said hub, an annular ratchet located between the backing member and the hub and mounted for rotation on said shaft, said ratchet being composed of a composite brake material and having a generally flat surface disposed to engage said backing member, predetermined axial movement of said hub on said shaft caused by rotation of said hand wheel effecting a braking engagement of said ratchet with said backing member so that continued rotation of said hand wheel will rotate the shaft and thereby rotate said drum, and a pawl mounted on one of said side plates to engage said ratchet.

8. A boat lift, comprising a supporting structure, a lift frame mounted on the supporting structure and disposed to support a boat and movable between a lower position and an elevated position, a winch mounted on the supporting structure and including a pair of spaced side members, a shaft mounted for rotation with respect to said side members with an end of said shaft being threaded and projecting beyond a side member, a drum disposed between the side members and operably connected to said shaft, a cable wound on the drum and connected to said lift frame, manually operated drive means connected to the projecting end of the shaft for rotating the shaft and including a hub threadedly engaged with the projecting end of said shaft whereby rotation of said manually operated drive means will move the hub axially of said shaft, a backing plate connected to said shaft and located outside of said side members, an annular ratchet plate mounted for free rotation relative to said shaft and having a plurality of spaced teeth, said ratchet plate having a generally flat surface facing said backing plate and being composed of a composite brake material, whereby a predetermined amount of axial movement of said hub on said shaft caused by rotation of said drive means in a first direction will effect engagement between said flat surface and said backing plate so that further rotation of said drive means in said first direction will rotate the shaft to thereby rotate said drum and move said lift frame from the lower to the elevated position, and pawl means mounted on one of said side members and disposed to engage the teeth of said ratchet plate to thereby hold said lift frame in an elevated position, rotation of said drive means and said shaft in a second direction acting to disengage said flat surface from said backing plate to enable said lift frame to move from the elevated to the lower position.

9. The boat lift of claim 8, wherein said drum has a cylindrical section on which said cable is wound, a projection extending outwardly from said cylindrical section and canted in said second direction, said cable having a loop engaged with said projection, full unwinding of said cable from said cylindrical section automatically releasing said loop from said projection to prevent reverse rotation of said drum and shaft.

10. A boat lift, comprising a supporting structure, a lift frame mounted on the supporting structure disposed to support a boat and movable between a lower position and an elevated position, a winch mounted on the supporting structure and including a pair of spaced side members, a shaft mounted for rotation with respect to said side members with an end of said shaft being threaded and projecting beyond a side member, a drum disposed between the side members and operably connected to said shaft, a cable wound on the drum and connected to said lift frame, manually operated drive means connected to the projecting end of the shaft for rotating the shaft, said drum including a cylindrical section on which said cable is wound, and a hook projecting outwardly from said cylindrical section, said cable being releasably engaged with said hook, said hook being constructed and arranged such that full unwinding of said cable from said drum will automatically release said cable from said hook to prevent reverse rotation of said drum and said shaft.

* * * * *

UNITED STATES PATENT AND TRADEMARK OFFICE

CERTIFICATE OF CORRECTION

PATENT NO. : 5,211,124

DATED : May 18, 1993

INVENTOR(S) : JOHN N. REISER

It is certified that error appears in the above-indentified patent and that said Letters Patent is hereby corrected as shown below:

Col. 5, Line 44, CLAIM 1 Cancel "protecting" and substitute therefor --projecting--; Col. 5, Line 46, CLAIM 1 Cancel "or" and substitute therefor --on--; Col. 6, Line 7, CLAIM 4, After "the" insert --first--; Col. 6, Line 7, CLAIM 4 After "said" insert --first--; Col. 6, Line 8, CLAIM 4 After "the" insert --first--; Col. 6, Line 13, CLAIM 5 After "said" insert --first--; Col. 8, Lines 4-5, CLAIM 10 Delete "being threaded and".

Signed and Sealed this

Fifth Day of July, 1994

Bruce Lehman

*Attest:*

BRUCE LEHMAN

*Attesting Officer*

*Commissioner of Patents and Trademarks*